US008506427B2

(12) United States Patent
Webb et al.

(10) Patent No.: US 8,506,427 B2
(45) Date of Patent: Aug. 13, 2013

(54) SPORTS THROWING TRAINING DEVICE

(75) Inventors: Dennis A. Webb, New Palestine, IN (US); Lake D. Webb, New Palestine, IN (US)

(73) Assignee: Lake7, Inc., New Palestine, IN (US)

( * ) Notice: Subject to any disclaimer, the term of this patent is extended or adjusted under 35 U.S.C. 154(b) by 139 days.

(21) Appl. No.: 12/965,173

(22) Filed: Dec. 10, 2010

(65) Prior Publication Data

US 2011/0111890 A1 May 12, 2011

Related U.S. Application Data

(63) Continuation-in-part of application No. 12/479,379, filed on Jun. 5, 2009, now Pat. No. 8,323,127.

(60) Provisional application No. 61/059,454, filed on Jun. 6, 2008.

(51) Int. Cl.

| | |
|---|---|
| ***A63B 69/00*** | (2006.01) |
| ***A63B 69/26*** | (2006.01) |
| ***A63B 69/30*** | (2006.01) |

(52) U.S. Cl.

USPC ..... 473/458; 473/422; 473/450; 473/451

(58) Field of Classification Search

USPC ..... 473/458, 450, 464, 422, 438, 212–217; 482/121, 124–126

See application file for complete search history.

(56) References Cited

U.S. PATENT DOCUMENTS

| | | | | | |
|---|---|---|---|---|---|
| 650,656 | A * | 5/1900 | Raabe | 482/124 |
| 866,495 | A * | 9/1907 | Marks | 482/124 |
| 2,274,574 | A * | 2/1942 | Zerne | 482/129 |
| 2,488,534 | A * | 11/1949 | Hagerman | 482/41 |
| 3,162,441 | A * | 12/1964 | Karlik | 482/124 |
| 3,774,572 | A * | 11/1973 | Borraccio | 473/207 |
| 5,137,272 | A * | 8/1992 | Wilkinson | 482/124 |
| 5,176,377 | A * | 1/1993 | Wilkinson | 482/120 |
| 5,358,461 | A * | 10/1994 | Bailey, Jr. | 482/2 |
| 5,431,617 | A * | 7/1995 | Rattray, Jr. | 482/129 |
| 5,618,249 | A * | 4/1997 | Marshall | 482/127 |
| 5,647,827 | A * | 7/1997 | Gutkowski et al. | 482/124 |
| 5,792,034 | A * | 8/1998 | Kozlovsky | 482/124 |
| 5,993,362 | A * | 11/1999 | Ghobadi | 482/124 |
| 6,132,346 | A * | 10/2000 | Weeks | 482/124 |
| 6,280,365 | B1 * | 8/2001 | Weber et al. | 482/124 |
| 6,629,912 | B2 * | 10/2003 | Downs | 482/124 |
| 7,297,090 | B2 * | 11/2007 | Torres | 482/74 |
| 7,628,742 | B2 * | 12/2009 | Weaver | 482/125 |
| 7,780,583 | B2 * | 8/2010 | Brown | 482/112 |
| 2003/0125170 | A1 * | 7/2003 | Vernon | 482/124 |
| 2004/0053755 | A1 * | 3/2004 | Wilkinson | 482/124 |
| 2009/0098945 | A1 * | 4/2009 | George | 473/458 |

* cited by examiner

*Primary Examiner* — Mitra Aryanpour

(74) *Attorney, Agent, or Firm* — SmithAmundsen LLC; Dennis S. Schell

(57) ABSTRACT

A sports training device is worn by the trainee for developing skill and minimizing risk of injury in pitching, passing, swinging, kicking, and other such sports-related body movements. An illustrative embodiment includes an anchor member adapted for wear on the torso of a trainee, and elongate member coupled between the anchor member and a forearm or thigh of the trainee, the elongate member being resiliently bendable along its length, inelastic relative to its longitudinal axis, and freely movable relative to the anchor member upon movement of the trainee's arm or leg.

19 Claims, 5 Drawing Sheets

SPORTS THROWING TRAINING DEVICE

CROSS-REFERENCE TO RELATED APPLICATION

This application is a continuation in part and claims priority from U.S. application Ser. No. 12/479,379, filed Jun. 5, 2009, which claims the benefit of U.S. Provisional Patent Application No. 61/059,454, filed Jun. 6, 2008, and titled SPORTS THROWING TRAINING DEVICE, which are incorporated herein by reference.

FIELD OF THE INVENTION

The present disclosure relates to sports training devices, and particularly to a device worn by a trainee for strengthening throwing, such as pitching and passing, or other sports related body movements, including swinging and kicking.

BACKGROUND

Various sports motions such as pitching, throwing, passing, kicking, and swinging generally involve propelling a projectile like a ball or swinging an implement such as a bat. The skill of the trainee seeking to improve such sports motions and to prevent or minimize the risk of injury generally includes training to improve body strength, balance, speed of movement, and control/coordination of movement.

For example, when pitching a baseball, the strength, control, coordination, and speed associated with the trainee's glove-side leg motion or stride, the trainee's throwing arm, and the trainee's core muscles (muscles of the torso, i.e., other than those of the arms and legs) are essential in developing pitching skill and avoiding injury.

Various sports training devices provide training for sports motions. Some devices offer elastic or weight and pulley-based resistance between an attachment point on the trainee's body and an anchor point located on a machine, wall, floor, pole, or other fixed structure. However, such off-body anchoring disturbs the trainee's balance, provides a resistance vector not adequately related to the trainee's body mechanics, and typically does not provide for the desired full range of motion or an actual release of or contact with a ball. Other sports training devices are worn by the trainee and lack off-body anchoring; however, such devices typically only provide various structures that limit or guide motion and do not offer resistance to improve core or peripheral body strength. Yet other sports training devices do provide resistance between an attachment point on the trainee's body and an anchor point on the trainee's body but fail to offer resistance that does not impede free and natural movement of the arm and/or leg, thus these devices may provide negative training of coordination of movement or even injury. Weighted balls sometimes used for such training risk overstressing and damaging muscles and joints such as the shoulder.

SUMMARY OF THE INVENTION

The present invention may comprise one or more of the following features and combinations thereof. An illustrative sports training device includes an anchor member adapted for wear on the torso of a trainee; a first tension device coupled between the anchor member and a trainee's first appendage; and the first tension device including a elongate first member having a proximal and distal end, the proximal end coupled to the anchor member and the distal end movable through at least two axes relative to the anchor member. The movement about three axes may be enabled by resilient bending of the elongate first member along its length upon movement of the trainee's first appendage. The elongate first member may be inelastic relative to its longitudinal axis, for example, a composite rod, such as a fiberglass rod. Selective adjustment of tension may be provided by the elongate first member by the trainee's selection of the elongate first member from a plurality of composite rods of at least one of varying length and varying cross-section.

The anchor member may include a resiliently bendable mount for receiving the proximal end of the elongate first member, for example, an elongate rubber member, the rubber member defining an opening along its length for releasably receive a portion of the length of the proximal end of the elongate first member. The rubber member may be fixed to the anchor member at an intermediate point between its proximal and distal ends such that the proximal and distal ends are movable relative to the anchor member. The mount may further include a non-formable plug coupled to the proximal end of the rubber member, the plug defining an opening for receiving a portion of the length of the proximal end of the elongate first member. The anchor member may also be adapted to provide selective adjustment of tension, for example, provided by the trainee's selection of the mount from a plurality of mounts having varying degrees of resistance to bending.

The sports training device may also include a second tension device coupled at a first end to the anchor member and adapted at a second end to be coupled to a trainee's second appendage, for example, an elastic cord coupled to a trainee's thigh. The anchor member may include a releasable belt for securing the training device about a trainee's torso, the releasable belt and anchor member adapted to stably position the proximal end of the elongate first member adjacent the small of the back, for example, a lumbar back support belt. The sports training device may also include an appendage cuff adapted to couple the elongate first member to at least one of a trainee's forearm and trainee's leg. The first tension device may further include a second member, the second member having a proximal and distal end, the proximal end of the second member coupled to the distal end of the elongate first member and the distal end of the second member coupled to the appendage cuff, for example, a rigid second member.

In another embodiment, the sports training device includes an anchor member adapted for wear on the torso of a trainee; an elongate member having a proximal and distal end, the proximal end coupled to the anchor member and the distal end coupled to an appendage of the trainee; and an appendage cuff adapted to couple the elongate member to at least one of a trainee's forearm and trainee's leg just below the knee; and the elongate member is resiliently bendable along its length, inelastic relative to its longitudinal axis, and freely movable relative to the anchor member upon movement of the trainee's appendage. The anchor member may also include a resiliently bendable mount for receiving the proximal end of the elongate member.

The trainee's appendages include the arms and legs. The distal portion of the trainee's arm may include a hand, wrist, or forearm area distal of the elbow. The medial portion of the trainee's arm is proximal of the elbow, for example, the bicep. The distal portion of the trainee's leg may be an ankle, heel, foot, lower leg or distal of the knee. The medial portion of the trainee's leg is proximal of the knee, for example, the thigh. In one illustrative embodiment, the training device includes a cuff adapted to couple the elongate member to the trainee's forearm. The training device, in one embodiment, includes a harness adapted to couple the second tension device to the trainee's thigh.

Although an illustrative embodiment is configured for baseball pitching training, other embodiments may be configured for a different sport or athletic motion, and one illustrative embodiment of the device is reconfigurable for use with various sports and athletic motions, including, but not limited to passing, throwing, swinging, and kicking, and/or for trainees having different heights or strengths. For example, the first tension device may be coupled to the trainee's leg depending on the motion and appendage for which the trainee is training.

Advantageously, the illustrative device is portable and can be used wherever worn by the trainee. Strengthening core muscle groups and specific muscle units reduces risk of injury to joints and tendons, for example, those of the elbow and shoulder.

Additional features of the disclosure will become apparent to individuals skilled in the art upon consideration of the following detailed description of the illustrative embodiment.

BRIEF DESCRIPTION OF THE DRAWINGS

The detailed description particularly refers to the accompanying figures in which.

DETAILED DESCRIPTION OF THE ILLUSTRATIVE EMBODIMENTS

Figure 1:
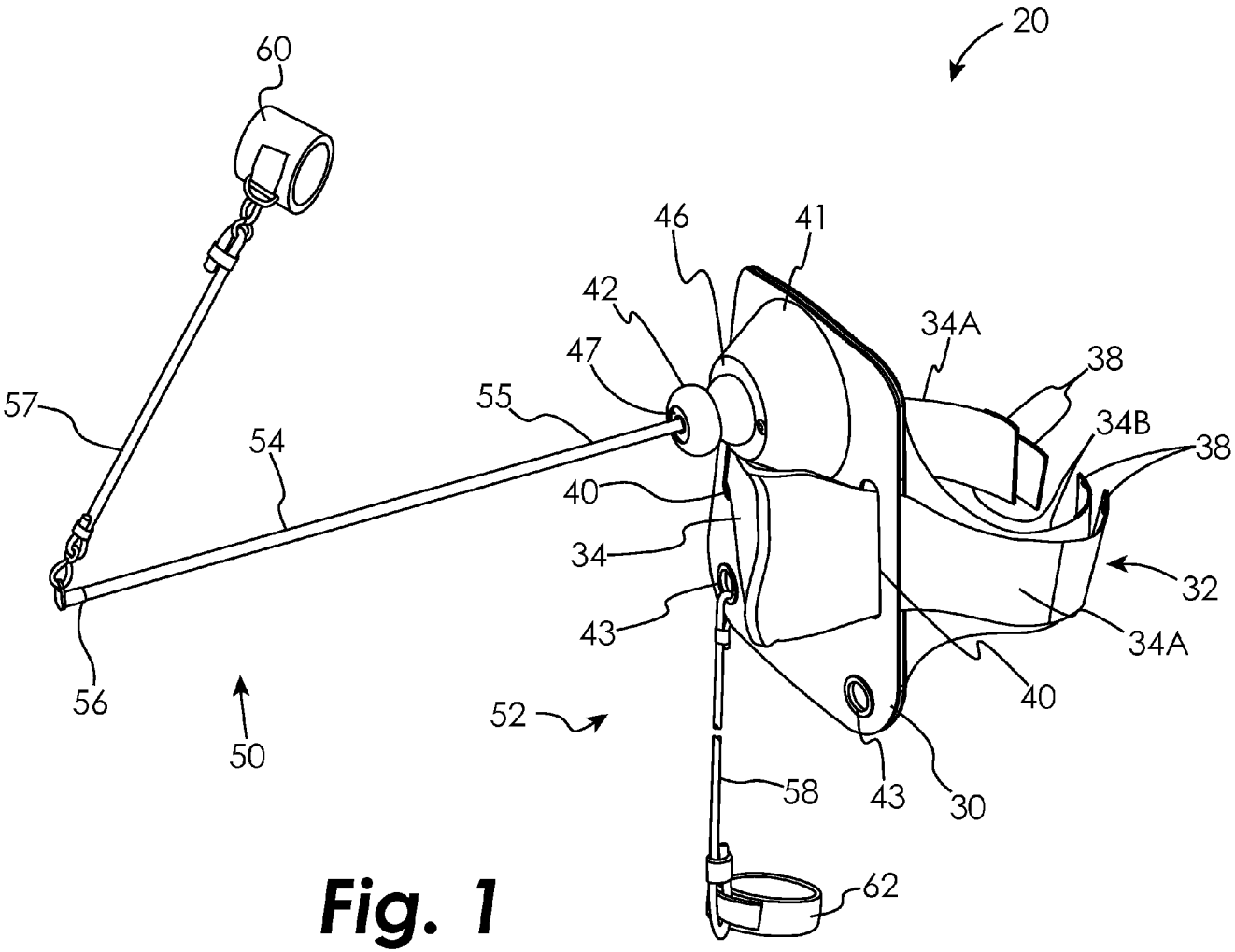
FIG. 1 is a perspective view of a first illustrative embodiment of a sports training device.

For the purposes of promoting and understanding the principals of the invention, reference will now be made to one or more illustrative embodiments illustrated in the drawings and specific language will be used to describe the same.

Referring to FIGS. 1 through 5, an illustrative embodiment of a sports training device 20 is shown. The training device 20 includes an anchor member 30 which is worn on a trainee's torso 24, for example, adjacent the back portion of the torso 24. In the illustrative embodiment, the anchor member 30 is generally planar with a slight curvature side-to-side to fit and be retained in position on the backside of the torso 24 by a restraint 32. For example, the restraint 32 may include one or more belts, ties, a harness, a vest, buckles, or other releasable or wearable features for fixing the position of the anchor member 30 relative to the torso 24. For example, restraint 32 may be a lumbar back support such as part number 255 or others available from Mueller Sports Medicine of Sauk Prairie, Wis.

The illustrative training device 20 also includes a first tension device 50, including, for example, a first attachment device 60 adapted to couple the distal end of an elongate first member 54 to the anchor member 30. Anchor member 30 includes a mount 41, which includes an elongate rubber member for securing the elongate first member 54 to the anchor member 30. Optionally, the first tension device 50 may also include a second member 57 coupling the distal end of the elongate first member 54 to the anchor member 30. The second member 57 may be an elastic cord, an inelastic cord, or a rigid member. Optionally, the illustrative training device 20 can also include a second tension device 52, including, for example, an elastic cord 58 coupled between the anchor member 30 and a second attachment device 62, which is adapted to be coupled to a trainee's leg 70.

In the illustrative embodiment, the elongate first member 54 is resiliently bendable along its length and inelastic relative to its longitudinal axis, for example, a composite rod, whether solid or hollow in actual cross-section, for example those constructed of fiber glass. In the illustrative embodiment, the elongate first member 54 if fixed directly to the anchor mount 30 tended to fracture as the bend along its length approached or exceeded 90 degrees; however, the incorporation of the mount 41 and the elongate rubber member 42 provides movement of the proximal end 55 of the elongate first member 54 thereby keeping the bend below 90 degrees throughout the whole range of motion of the arm 66 or leg 70. A covering of tape, foam or other material may be used over the outer surface of the elongate first member 54 to retain the materials in the event of fracturing. Any rigid or semi-rigid material may be used to manufacture the anchor member 30, including, for example, a composite material such as carbon fiber, or Aquaplast® brand material (a trademark of and available from Paterson Medical/Sammons Preston, of Bolingbrook, Ill.), which is sloughed, heated, and melted over a formed template, rather than formed using a costly molding process.

Figure 2:
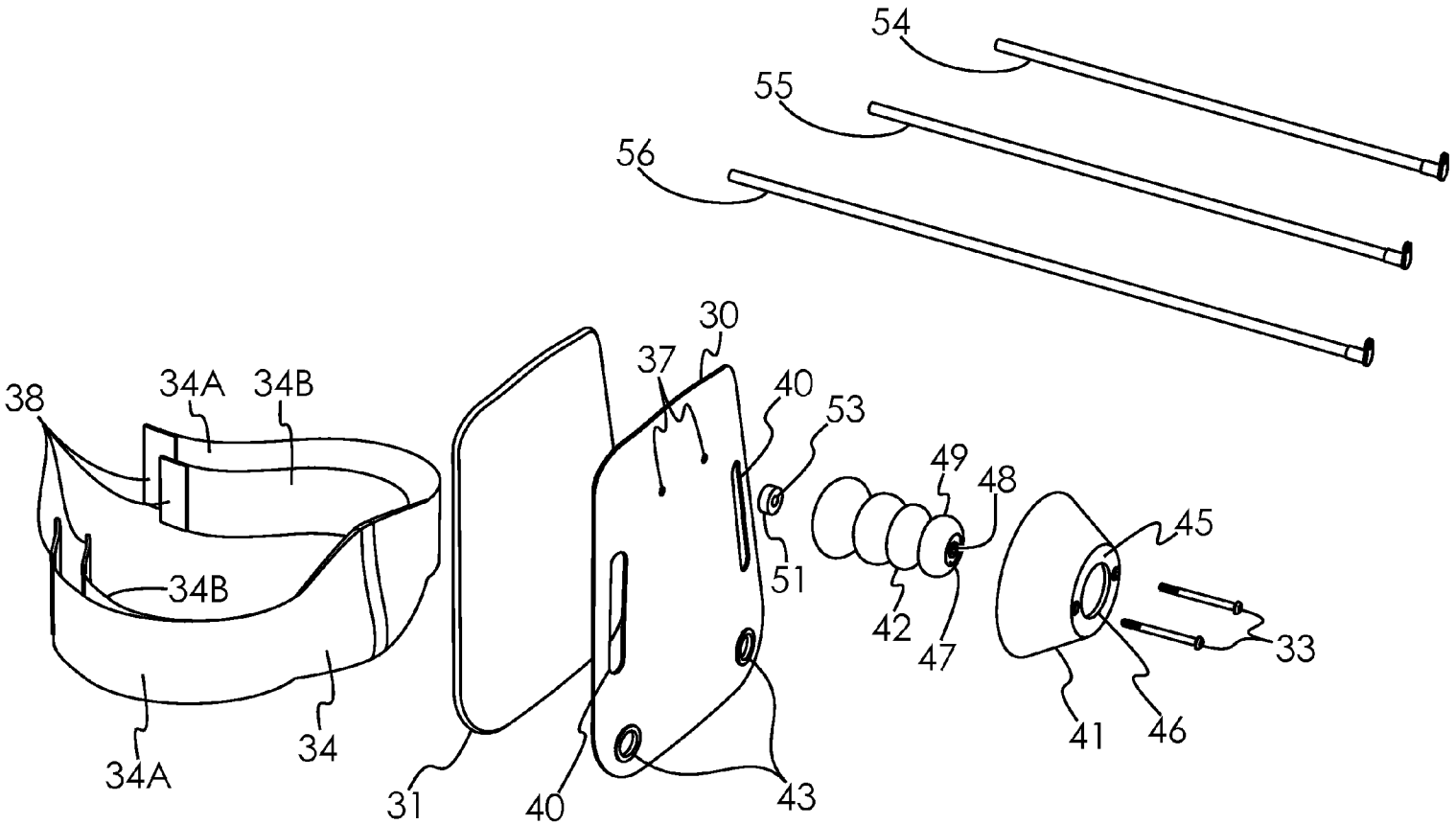
FIG. 2 is an exploded view of the sports training device of FIG. 1.

In the first illustrative embodiment, as shown in FIGS. 1 and 2, the restraint 32 includes one or more web belts 34A and 34 B and hook and loop fasteners 38. The restraint 32 is coupled, releasably or non-releasably, with the anchor member 30. For example, the belts 34 extends through a pair of slots 40 formed by opposite side portions of the anchor member 30. Alternatively, the restraint 32 may be integral with the anchor member 30. The restraint 32 is releasably coupled with the trainee's torso 24, for example, by securing the hook and loop fasteners 38 such that the belt 34 fits snugly around the torso 24, thus substantially preventing movement of the anchor member 30 relative to the torso 24. The hook and loop fasteners 38 can be composed of a fabric hook and loop fastener, such as that sold under the VELCRO brand name by Velcro USA, Inc., of Manchester, NH, but, additionally or alternatively, can include buckles and other releasable mechanisms for fastening.

In the illustrative embodiment as depicted in particular in FIG. 2, mount 41 is coupled to the anchor member 30 by fasteners 33 cooperating with holes 37. The mount 41 may be a thin walled member that is generally coned shaped having a truncated distal end 47 defining an opening 45 sized for receiving and retaining an elongate rubber member 42. The elongate rubber member 42 defines opening 48 extending from distal end 47 and for receiving a proximal end 55 of the elongate first member 54. The opening 48 may extend partially along the length of the rubber member 42, or in the case of the illustrative embodiment, the opening 48 extends into an interior cavity (not shown) of member 42 which is closed off by a rigid plug 51 defining an opening 53 for receiving the proximal end 55 of the elongate first member 54. In the illustrative embodiment, the openings 48 and 53 are sized to releasably receive the elongate first member 54; however, a press fit may also be used for securely receiving the elongate first member.

In one embodiment, the first tension device 50 includes a plurality of elongate first members 54-56, which are bendable rods, for example, fiberglass rods, one of which is selected and coupled at its distal end 56, with second member 57 and coupled to anchor member 30, for example, releasably, at its proximal end 55 by mount 41. The number of elongate first members 54-56 which may be selectively employed is not limited. Such fiberglass or other composite rods are available from Diversified Structural Components of Erlanger, Ky. Illustrative lengths of elongate first members 54-56 are 18 to 30 inches and illustrative diameters are ⅛ to ⅜ inches.

Advantageously, selection of one of a plurality of elongate first members 54-56 and/or selection of one of a plurality of elongate rubber members 42 provides selective tension between the anchor member 30 and the arm 66 or leg 70. For example, the tension applied by the elongate first member 54 is related to its relative resistance to flexing. The resistance to flexing varies, for example, with the material used and the length of and axial cross-section of the elongate first member 54. Additionally, the tension applied by the elongate rubber member 42 is related to its relative resistance to flexing. The degree of deformability, resistance to flexing, varies, for example, with the material used and the length of and axial cross-section of the elongate rubber member 42.

In the illustrative embodiment, is been found that the preferred tension allows free and natural movement of the arm 66 or leg 70 through a full range of motion to be trained, while adding some resistance to the movement of the arm 66 or leg 70 that advances strength and coordination conditioning over that experienced without the use of the training device 20. A higher or lower tension can be selected depending on whether training is directed to only the range of motion (higher) or actual throwing or kicking or the like (lower). Advantageously, the combination of materials used for and features in the elongate first member 54 and the elongate rubber member 42 in the above illustrative embodiment provides approximally uniform tension to the arm 66 or leg 70 through a full range of motion for the arm 66 or leg 70, especially when an inelastic and/or rigid material is used for the second member 57.

Additionally, in an embodiment where the respective elongate first members 54-56 is used in combination with a second member 57 comprising an elastic cords, the tension applied to arm 66 or leg 70 may be an increasing tension, decreasing tension, or some combination thereof, relative to the extension and/or retraction through a range of motion for the arm 66 or leg 70.

The anchor member 30 can also have at least one aperture 43 through which the elastic cord 58 may pass and be secured; this aperture 43 may include protective eyelets, bearings, bushings, and/or anti-friction features.

Figure 3:
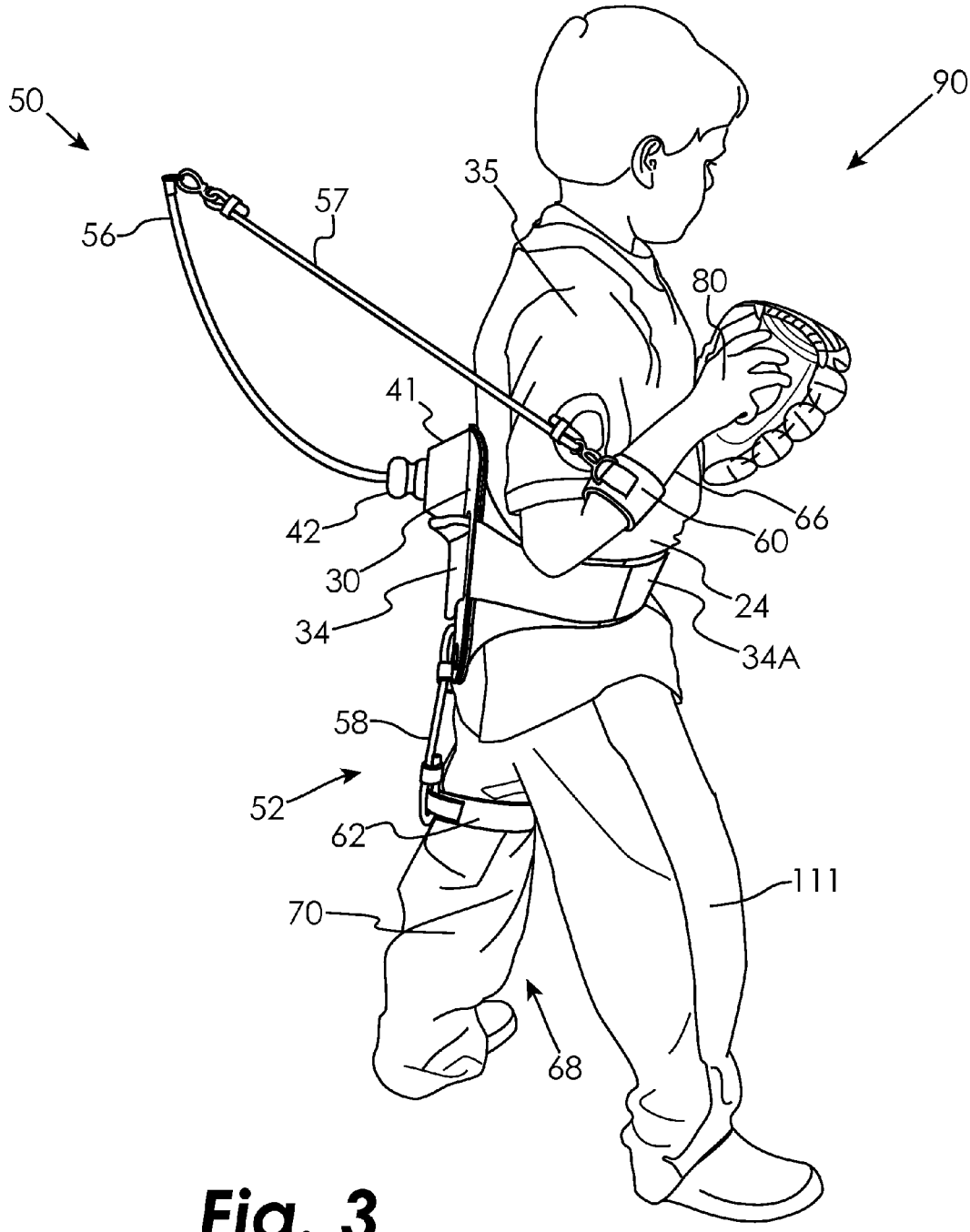
FIG. 3 is a side view of the sports training device of FIG. 1 being worn by a trainee according to the present disclosure.
Figure 4:
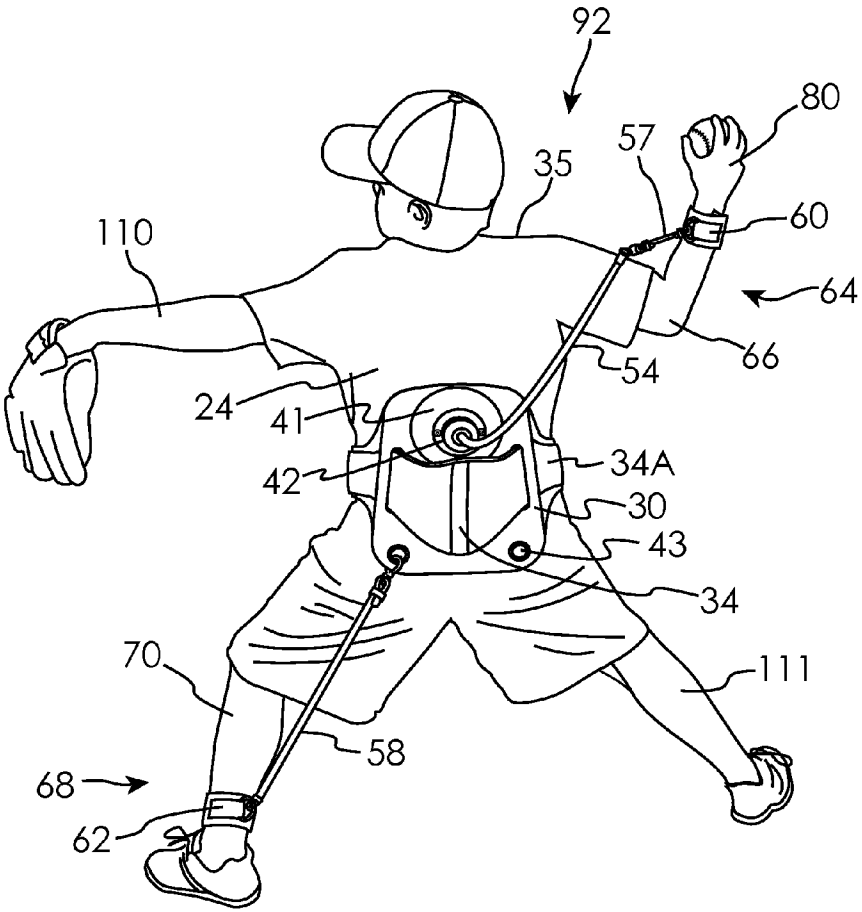
FIGS. 4 and 5 are a sequence of views illustrating the sports training device worn by the trainee of FIG. 3 while executing a baseball pitch.
Figure 5:
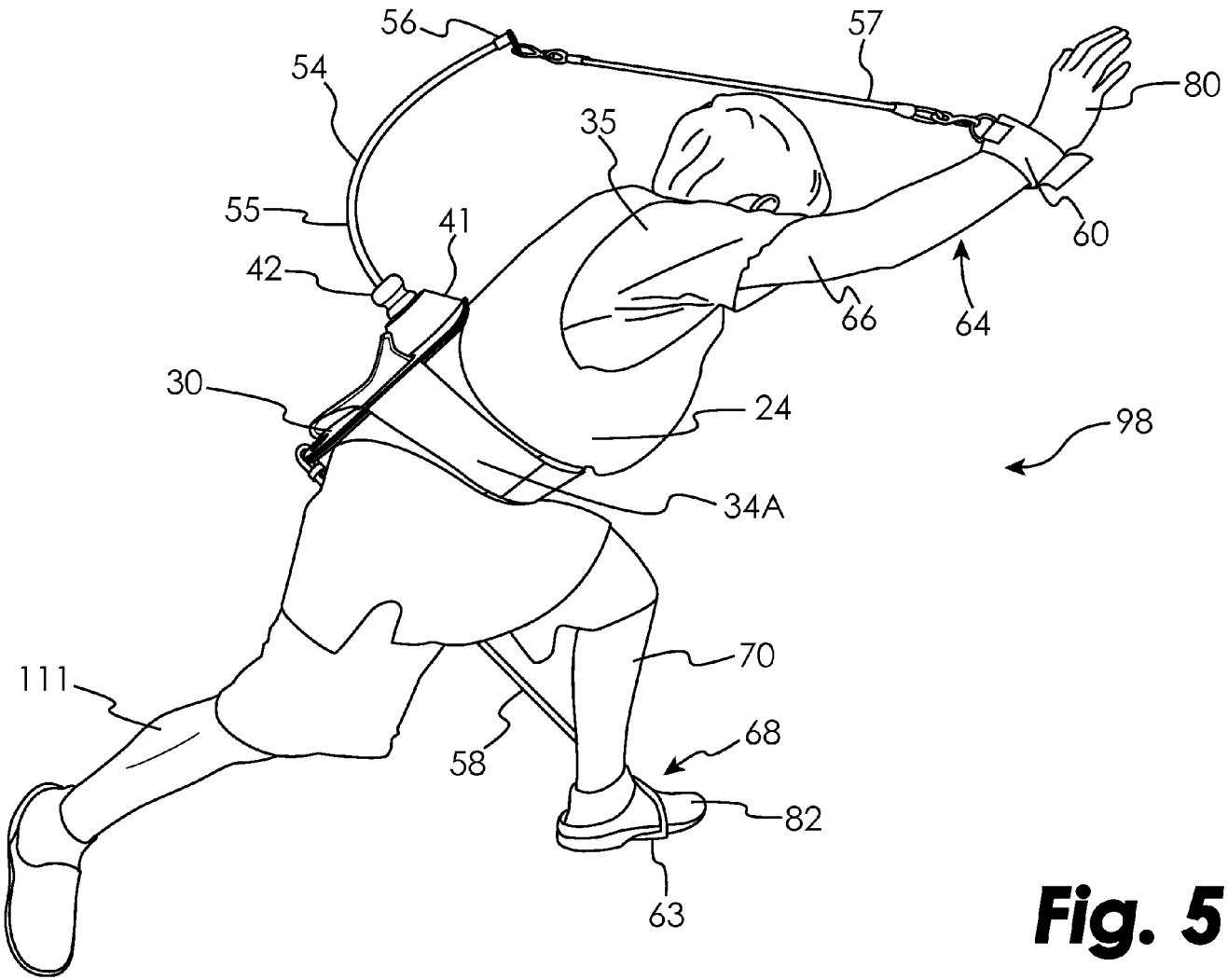

As shown in FIGS. 3-5, the first attachment device 60 provides coupling of the first tension device 50 with a distal portion 64 of a throwing/swinging arm 66, for example, the forearm adjacent the elbow, or coupling to the arm 66 adjacent both sides of the elbow. Alternatively, the first attachment device 60 can be coupled with a medial portion of the arm 66, for example, proximal to the bicep. The second attachment device 62 is optional and provides coupling of the second tension device 52 with a distal portion 68 of a trainee's leg 70, for example, the leg 70 being the one opposite the arm 66. This lower-body tension can provide lower-body/core strength training and may provide stability to anchor member 30 to counteract the upper-body motion and tension. Alternatively, the second tension device 52 is coupled with the thigh of the trainee's leg 70.

The mount 41 can be composed of a composite, spun metal, plastic, or other material, and can be hollow. In the illustrative embodiment, the annular groove 49 defined around the circumference of an intermediate position the long the length of the elongate rubber member 42 interacts with the opening 46 defined at the distal and 45 of the mount 41 to securely fix the rubber member 42 to the mount 41, while allowing bending movement of the elongate rubber mount along its length, including at both ends. In the illustrative embodiment, the elongate rubber member 42 is heated to temporarily increase its deformability so that it may be press fit into position, i.e. the annular groove 49 adjacent the opening 46. Together, the mount 41, the elongate rubber member 42, and the plug 51 form a resilient bendable mount for coupling the elongate first member 54 with the anchor member 30. The elongate rubber member 42 can be constructed from natural rubber components available from Kong Products of Golden, Colo.

In one embodiment, the elongate first members 54-56 are threaded at their proximal ends and screw into threads defined by the plug 51 associated with the elongate rubber member 42, or otherwise include a twist locking feature to retain elongate first members 54-56 to plug 51; however, it has been found in practice that providing the openings 48 and 43 as a slip fit are sufficient for retaining the elongate first member 54-56 to the mount 41 while the training device 20 is in use.

In the first illustrated embodiment, the first attachment device 60 may be a strap or cuff and the second attachment device 62 may be a strap or a harness. The first attachment device 60 may also be a glove adapted to be worn on a hand 80 of the trainee's arm 66 and to releasably, nonreleasably, or integrally coupled with the first tension device 50. Alternatively or additionally, the first attachment device 60 may be a different member adapted to releasably couple to a different portion trainee's arm 66, for example, a harness, sling, band, or other member coupled to one or more of the upper arm, elbow, forearm, wrist, hand, or digits of the distal arm portion 64 or medial arm portion. In one embodiment, the training device 20 includes a plurality of different first attachment devices 60 which may be selectively coupled with the anchor member 30 by releasably coupling the first tension device 50 to at least one of the attachment devices 60 or the anchor member 30.

Similarly, FIG. 5 shows the second attachment device 62 may be a harness 63 adapted to releasably couple with a foot 82 or other portion of the trainee's leg 70, for example, a medial portion such as the thigh, and to releasably, nonreleasably, or integrally couple with the second tension device 52. Alternatively or additionally, a sling, band, cuff, shoe, or other member can be coupled to one or more of the knee, calf, ankle, or foot of the medial or the distal leg portion 68. In one embodiment, the training device 20 includes a plurality of different second attachment devices 62 that may be selectively coupled with the anchor member 30 by releasably coupling the second tension device 52 to at least one of the attachment devices 62 or the anchor member 30.

In the first illustrated embodiment, the first and second tension devices 50 and 52 may include, respectively, cords 57 and 58. The cords 57 and 58 may consist of, for example, surgical tubing, and their tension, including the resistance to extension of the cord length and the recoil force to retract the cord length in this embodiment, is determined by the particular elastic properties of the cord selected, the resting length of the cord, for example between the first attachment device 60 and the elongate first member 54, and the range of motion of the trainee's arm 66. Color coding may be employed to easily identify the resistance and/or length of the cords 57 and 58.

In addition to variations in tension discussed above, the tension may also be selectively changed, for example, by using a different cross section or cord material or by retying or otherwise adjusting to provide a different resting length between the first attachment device 60 and the elongate first member 54. The particular one of the tension devices 50 or 52 and its location and displacement relative to the distal arm portion 64, or a medial arm portion, and the distal leg portion 68, or a medial leg portion, will also selectively change the tension provided by the training device 20. The resulting tensions for extension and retraction may be symmetric or asymmetric.

The training device 20 may also include comfort and/or safety devices. For example, a comfort pad 31 may be utilized between the anchor member 30 and the trainee's torso 24. As contemplated, the comfort pad is coupled to the anchor member 30 and could be made of material such as memory foam. Advantageously, the comfort pad 31 may also be shaped to facilitate proper positioning of the anchor member 30 and thus the proximal end 55 of the elongate first member 54 relative to the trainee's back, preferably above the waist over the small of the back as shown in FIGS. 3-5.

FIGS. 3-5 illustrate the use of the training device 20 through a range of motion of the trainee's arm 66, in this case the pitch of a baseball. Specifically, FIG. 3 illustrates a ready position 90, FIG. 4 a windup position 92, and FIG. 5 a release position 98. As the motion and position associated with the trainee's arm 66, leg 70, torso 24, and opposite arm 110 and leg 111 change, the training device 20 provides a tension to the arm 66 and, optionally, the leg 70, thereby providing the desired conditioning relating to pitching and body strength, balance, speed of movement, and control/coordination of movement.

Advantageously, it is found that the arrangement of the mount 41, elongate rubber member 42, and elongate first member 54 when positioned in an un-tensioned rest position as shown in FIG. 1, e.g., The elongate first member 54 being about perpendicular with the anchor member 30 and thus with the back of the trainee, allows for unencumbered movement of the distal end 56 of the elongate first member 54 with the movement of the arm 66 or leg 70, and also approximally uniform tension applied to the arm 66 or leg 70 the training device 20. For example, the distal end 56 of the elongate first member 54 will move through the three axes in order to remain directly behind the arm 66 or leg 70, thus substantially reducing or eliminating tensions applied at a vector that may result in injury to the arm 66 or leg 70.

The training device 20 may also include other comfort and/or safety devices, including, but not limited to, a back cushion pad. The training device 20 may also be used for typical strengthening and/or toning exercises, for example, standing bench presses, curls, and squats.

While the invention has been illustrated and described in detail in the foregoing drawings and description, the same is to be considered as illustrative and not restrictive in character, it being understood that only illustrative embodiments thereof have been shown and described and that all changes and modifications which are within the scope of the claimed subject matter are desired to be protected.

What is claimed is:

1. A sports training device comprising:

an anchor member adapted for wear on including a restraint for coupling the anchor member to the torso of a trainee;

a resiliently bendable mount coupled to the anchor member and having a distal extending distally from the anchor member;

a first tension device coupled between the resiliently bendable mount and a trainee's first appendage; and the first tension device including an elongate first member having a proximal and distal end, the proximal end coupled directly to the distal end of the resiliently bendable mount and the distal end coupled to the trainee's first appendage and wherein upon movement of the trainee's first appendage applying tension to the first tension device, a distal end of the resiliently bendable mount and the distal end of the elongate first member move laterally movable through at least two axes relative to the anchor member, and the resiliently bendable mount is resistant to flexing and provides tension to the elongate first member.

2. The sports training device according to claim 1, wherein the movement about two axes is enabled by resilient bending of the resiliently bendable mount and resilient bending of the first member along its length upon movement of the trainee's first appendage.

3. The sports training device according to claim 2, wherein the first member is inelastic relative to its longitudinal axis.

4. The sports training device according to claim 3, wherein the first member comprises a composite rod.

5. The sports training device according to claim 3, wherein the first tension device is adapted to provide selective adjustment of tension applied to the trainee's first appendage.

6. The sports training device according to claim 5, wherein the selective adjustment of tension is provided by the first member by trainee's selection of the first member from a plurality of composite rods of at least one of varying length and varying axial cross-section.

7. The sports training device according to claim 1, wherein the mount comprises an elongate rubber member, the rubber member defining an opening at an end for releasably receive a portion of the length of the proximal end of the first member.

8. The sports training device according to claim 7, wherein the rubber member is fixed to the anchor member at an intermediate point between its proximal and distal ends such that the proximal and distal ends are movable laterally relative to the anchor member.

9. The sports training device according to claim 8, wherein the mount further comprises a plug coupled to the proximal end of the rubber member, the plug defining an opening for receiving a portion of the length of the proximal end of the first member.

10. The sports training device according to claim 1, wherein the anchor member is adapted to provide selective adjustment of tension.

11. The sports training device according to claim 10, wherein the selective adjustment of tension is provided by the trainee's selection of the mount from a plurality of mounts of varying degrees of resistance to bending.

12. The sports training device according to claim 3, further comprising a second tension device coupled at a first end to the anchor member and adapted at a second end to be coupled to a trainee's second appendage.

13. The sports training device according to claim 12, wherein the second tension devices includes an elastic cord.

14. The sports training device according to claim 3, wherein the anchor member includes a releasable belt for securing the training device about a trainee's torso, the releasable belt and anchor member adapted to stably position the proximal end of the first member adjacent the small of the back.

15. The sports training device according to claim 3, further comprising an appendage cuff adapted to couple the first member to at least one of a trainee's forearm and trainee's thigh.

16. The sports training device according to claim 3, further comprising an appendage cuff, and wherein the first tension device further includes a second member, the second member having a proximal and distal end, the proximal end of the second member coupled to the distal end of the first member and the distal end of the second member coupled to the appendage cuff.

17. The sports training device according to claim 16, wherein the second member is a rigid.

18. A sports training device comprising:

an anchor member adapted for wear on including a restraint for coupling the anchor member to the torso of a trainee;

a resiliently bendable mount coupled to the anchor member and having a distal end extending distally from the anchor member;

an elongate first member having a proximal and distal end, the proximal end coupled to the distal end of the resiliently bendable mount and the distal end coupled to an appendage of the trainee; and an appendage cuff adapted to couple the distal end of the elongate first member to at least one of a trainee's forearm and trainee's thigh; and wherein the elongate first member is resiliently bendable along its length, inelastic relative to its longitudinal axis, and freely movable relative to the anchor member upon movement of the trainee's appendage, and the resiliently bendable mount is resistant to flexing and provides tension to the elongate first member.

19. The sports training device according to claim 18, further comprising a plurality of mounts having varying degrees of resistance to bending, and wherein the resiliently bendable mount is selected from the plurality of mounts.

* * * * *